US005152014A

United States Patent [19]

Marx et al.

[11] Patent Number: 5,152,014

[45] Date of Patent: Oct. 6, 1992

[54] BREATHABLE BODY WEAR

[75] Inventors: Gilda G. Marx; Robert S. Marx, both of Beverly Hills, Calif.

[73] Assignee: Gilda Marx Industries, Inc., Los Angeles, Calif.

[21] Appl. No.: 553,963

[22] Filed: Jul. 17, 1990

[51] Int. Cl.[5] ..... A41B 9/04

[52] U.S. Cl. ..... 2/406; 2/409; 2/78 B; 2/69; 2/402; 2/403; 2/400; 2/228; 2/407

[58] Field of Search ..... 2/406, 409, 67, 82, 2/78 B, 69, 403, 402, 400, 227, 228, 239, 407; 450/102, 103, 104, 105

[56] References Cited

U.S. PATENT DOCUMENTS

| | | | |
|---|---|---|---|
| 2,799,023 | 7/1957 | Goodman | 2/406 |
| 3,237,625 | 3/1966 | Johnson | 2/406 |
| 3,701,164 | 10/1972 | Blore | 2/409 |
| 3,909,851 | 10/1975 | Garrou et al. | 2/409 |
| 4,009,495 | 3/1977 | Faust | 2/406 |
| 4,031,568 | 6/1977 | Huff | 2/406 |
| 4,067,068 | 1/1978 | Bregstein et al. | 2/406 |
| 4,236,257 | 12/1980 | Williams et al. | 2/406 |
| 4,244,059 | 1/1981 | Pflaumer | 2/406 |

FOREIGN PATENT DOCUMENTS

| | | | |
|---|---|---|---|
| 1124610 | 11/1984 | Japan | 2/406 |

OTHER PUBLICATIONS

Bike Nashbar catalog #51, Late Summer '87, p. 5, Cycling Shorts & Liner.

Coolmax Newsletter, spring 1989.

*Primary Examiner*—Werner H. Schroeder

*Assistant Examiner*—Gloria Hale

*Attorney, Agent, or Firm*—Poms, Smith, Lande & Rose

[57] ABSTRACT

Women's body wear is provided with a panel in the crotch area which is formed of open or loosely knit material formed using threads made up of a bundle of hydrophobic fibers having a large surface area and longitudinally extending channels to provide drier, more comfortable and "breathable" body wear. The body wear garment may be provided with an open knit exterior panel generally coextensive with the inner panel, and of the same color as the remainder of the body wear garment.

13 Claims, 2 Drawing Sheets

BREATHABLE BODY WEAR

FIELD OF THE INVENTION

This invention relates to women's clothing, such as tights, bathing suits, leotards and pantyhose.

BACKGROUND OF THE INVENTION

The wearing of tight undergarments is one of the contributing factors of vaginitis, including one of the most common types, candidiasis, or yeast infection. One authority listed insulating clothing as one of the six host factors associated with higher incidence of vaginal yeast colonization. The others included pregnancy, contraceptives, diabetes, antibiotics and iron deficiencies. The itching and the discomfort associated with this infection are universal problems, and physicians often recommend that patients avoid tight clothing, or switch to panties and pantyhose with a cotton crotch. The wearing of cotton undergarments was previously advised due to cotton's ability to absorb moisture.

However, the retention of moisture in the cotton material may, in fact, aggravate the condition, or at least not ameliorate it significantly.

Accordingly, one object of the present invention is to provide women's body wear which provides drier conditions, and which contributes to a reduction in the conditions which favor yeast infections and vaginitis.

SUMMARY OF THE INVENTION

In accordance with the present invention, it has been determined that the use of a liner for women's body wear of an open knit material formed of a hydrophobic fiber having an irregular outer surface configuration and accordingly a high surface area, transports or "wicks" moisture away from the body, thereby helping to keep intimate areas drier, cooler and more comfortable. Collaterally, the moist conditions which favor the generation of yeast infections are reduced.

An open knit fabric formed of the Dupont fiber identified as "COOLMAX TM" has been found to have the desirable qualities for a liner for ladies' body wear, as outlined above.

In some cases it is useful to provide an inner open knit panel of high surface area hydrophobic fiber material and a mating outer knit panel of cotton or some similar absorbent material, both in the crotch area of the women's body wear. The outer panel may be dyed to be the same color as the remainder of the garment, while the inner panel may be natural, or not dyed so that it is maximally "wicking" in its action, and transports moisture away from the body.

The loosely knit inner panel is seamed along all of its edges to avoid unravelling. In some cases it is seamed to the women's body wear on all of its edges, and in other cases, for example where a panel is sewn into a bathing suit along only three sides, the fourth, free side of the panel has its edge seamed to avoid unravelling.

Other objects, features and advantages of the present invention become apparent from a consideration of the following detailed description and from the accompanying drawings.

DETAILED DESCRIPTION OF PREFERRED EMBODIMENTS OF THE INVENTION

Figure 1:
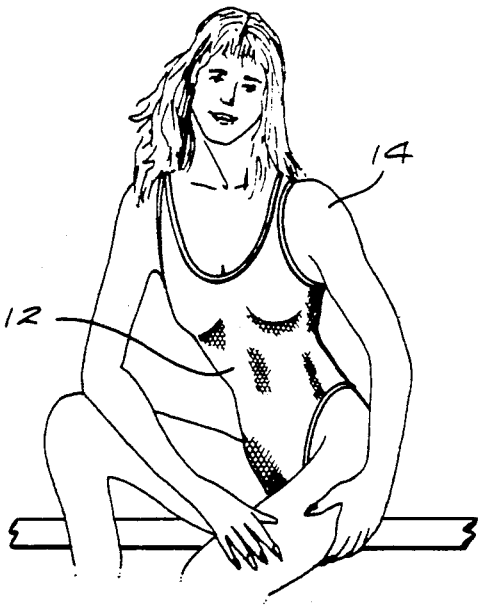
FIG. 1 shows a breathable body wear garment illustrating the principles of the invention, and being worn by a model.

Referring more particularly to FIG. 1 of the drawings, it shows a typical women's body wear garment 12 worn by a model 14. To be discussed hereinbelow is the new construction provided in the body wear, including a special panel in the crotch area of the body wear garment.

Figure 2:
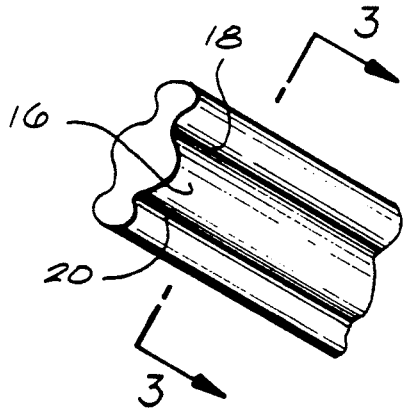
FIG. 2 is an isometric view of a fiber having a large surface area compared to its cross-sectional volume.
Figure 3:
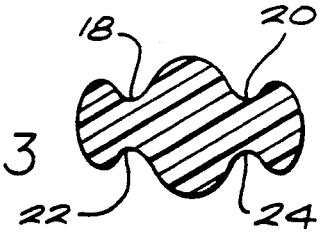
FIG. 3 is a cross-sectional view of the fiber of FIG. 2.

The special panel, as mentioned hereinabove, is formed of a loosely knit material in which the basic fiber has an irregular outer surface, preferably including longitudinally extending channels, and has a corresponding high surface area. One fiber which may be employed is the Dupont fiber sold under the trademark "COOLMAX TM." FIGS. 2 and 3 show the configuration of the basic COOLMAX fiber 16 with FIG. 2 being an isometric view of one end of one of the fibers, and FIG. 3 being a cross-sectional view taken along lines 3—3 of FIG. 2. The fiber has longitudinally extending channels 18, 20, 22 and 24, and these "wicking" channels transport liquid away from the body. The fiber is preferably made of hydrophobic material having low moisture absorption, which prevents clinging, and contributes to the lightweight "feel" characteristic of fabrics made using this fiber.

Figure 4:
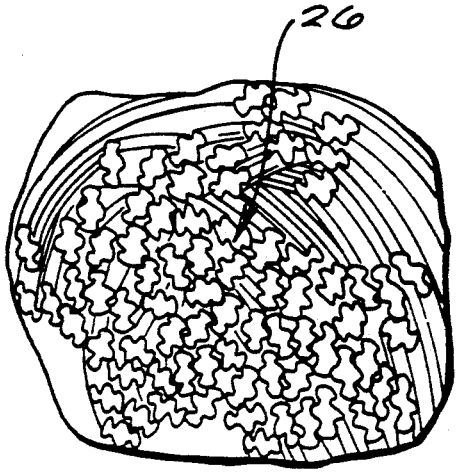
FIG. 4 shows a thread formed of a bundle of fibers of the type shown in FIGS. 2 and 3.

FIG. 4 is an end view of a thread formed of a bundle of the fibers of the type shown in FIGS. 2 and 3. The irregular packing of the fibers creates added voids in the fiber bundle, allowing greater moisture and vapor transport and breathability.

Instead of the cross-section as shown in FIG. 3, the fibers employed in the implementation of the present invention could be formed of other hydrophobic fibers having longitudinally extending channels, for example a generally circular fiber with a series of deep channels cut into its periphery, or a fiber having a cross-section similar to that of FIG. 3, but with another one or two bumps or lobes extending from the central area of the fiber, or from either or both of the two side lobes thereof.

Figure 5:
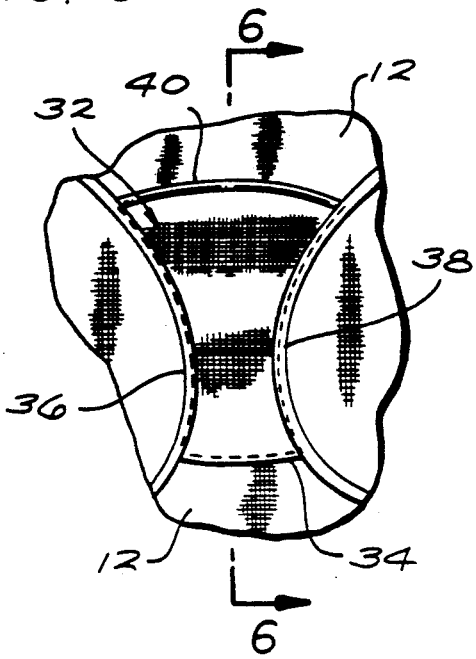
FIG. 5 shows an inner panel of loosely woven knit material located in the crotch area of the body wear garment as shown in FIG. 1, and employing threads of the type shown in FIG. 4.

FIG. 5 is a view showing the inside of the crotch area in the garment 12 of FIG. 1. In FIG. 5, the garment 12 appears at the upper and lower ends of the figure, and a special loosely knit panel 32 is seamed into the garment 12, along the line 34, and at the two sides 36 and 38 of the garment. The rear edge 40 of the knit insert is seamed to prevent unravelling of the knit fabric, but is not secured to the outer material 12 of the garment.

The knit panel 32 is formed of an open knit fabric, which may be formed using threads as shown in FIG. 4, made with fibers of the type shown in FIGS. 2 and 3. Accordingly, the panel 32 is a loose knit fabric with an open configuration, using hydrophobic fibers having an irregular outer surface, preferably including longitudinally extending channels, with the fibers therefore having a high surface area relative to the cross-sectional volume of the fiber.

Figure 6:
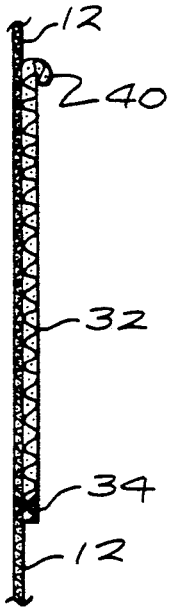
FIG. 6 is a cross-sectional view taken along lines 6—6 of FIG. 5.

FIG. 6 is a schematic cross-sectional view taken along lines 6—6 of FIG. 5. As indicated in FIGS. 5 and 6, the loosely knit panel 32 is seamed into the garment material along the seam 34 toward the front of the garment, and at the two side edges 36, 38 of the garment. The rear edge of the panel 32 is provided with a seam 40, as indicated in FIGS. 5 and 6, to prevent unravelling of the rear edge thereof, but is not secured to the garment 12. It is made of tightly woven or tightly knit, relatively thin material but includes resilient and stretchable fibers, so that the garment will stretch. As contrasted with the thinner, stretchable material 12, the panel 32 is looser, porous, and several times thicker, or at least twice as thick as the thinner material 12.

Figure 7:
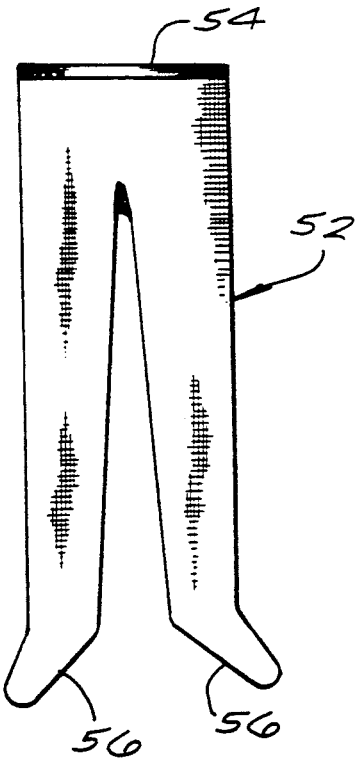
FIG. 7 shows a pair of black tights, illustrating the principles of the present invention.

Now, a different body wear garment, black tights, are shown in FIGS. 7 through 10 of the drawings. FIG. 7 shows an overall view of the tights 52 having an elastic waistband 54, and feet 56. The overall material of the black tights is a relatively thin, closely woven or tightly knit, thin material and is preferably stretchable. A typical fabric which may be used includes 64% cotton, 29% nylon, and 7% LYCRA TM.

Figure 8:
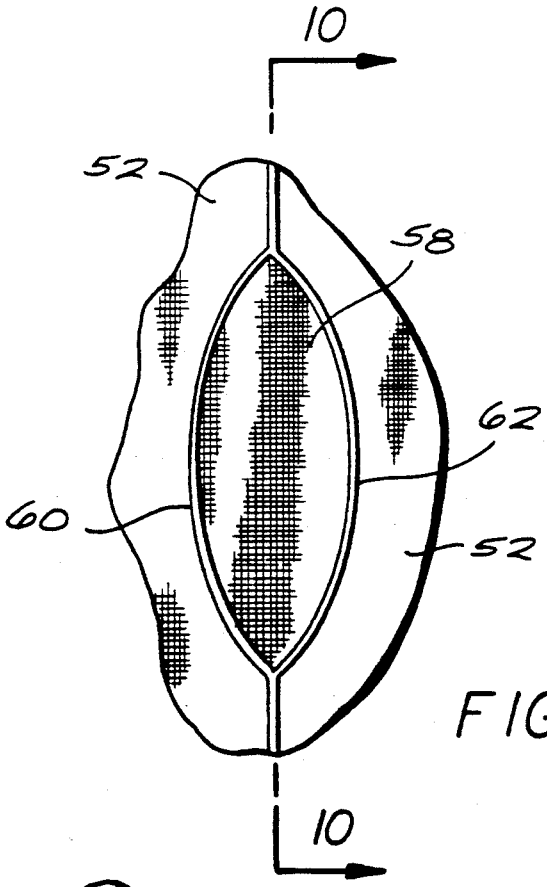
FIG. 8 is an outside view of the crotch area of the tights shown in FIG. 7.
Figure 9:
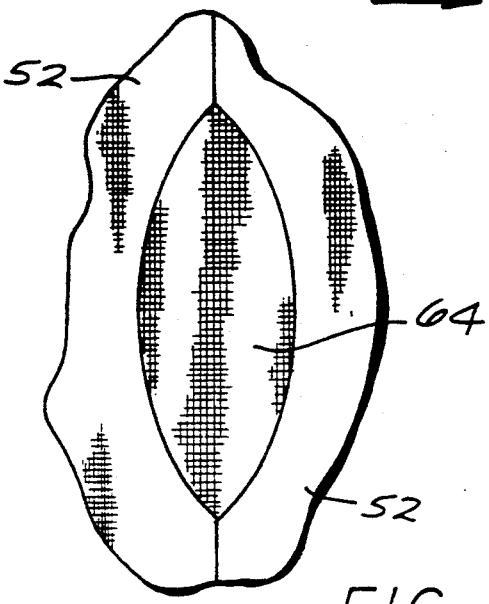
FIG. 9 is an inside view showing a crotch panel of open knit material, located on the inside of the tights of FIG. 7.
Figure 10:
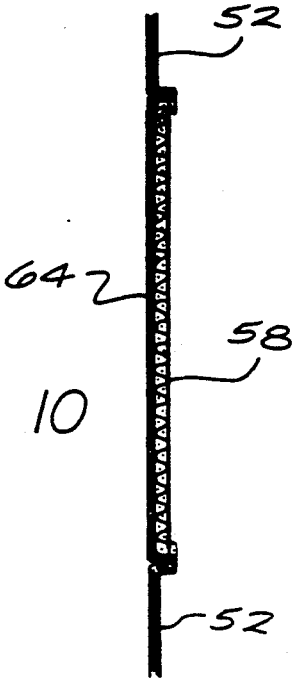
FIG. 10 is a cross-sectional view taken along lines 10—10 of FIG. 9.

FIGS. 8, 9 and 10 show the crotch area of the tights shown in FIG. 7. More specifically, FIG. 8 shows the loosely knit panel 58 which is sewn and fully seamed into the crotch area of the black tights 52. The panel 58 is substantially diamond-shaped and is seamed to the, adjacent material of the tights along the two seams 60, 62. FIG. 9 shows the outside of the tights in the crotch area, and shows a similar panel 64 which is coextensive with the inner panel 58, but is of the same color, black, as the remainder of the tights material 52. The panel 64 may be formed of loosely knit absorbent material, such as cotton. The cross-sectional view of FIG. 10 is taken along lines 10—10 of FIG. 8.

Using the configuration of FIGS. 7 through 10, moisture is "wicked" away from the body of the wearer, and transmitted to the absorbent panel 64 which is exposed to the air so that moisture absorbed there may be readily dried by exposure to the air. The result is a drier and more comfortable feeling for the wearer, with the drier conditions tending toward inhibiting potentially undesirable yeast growth or other possible infections.

In conclusion, it is to be understood that the foregoing detailed description and the accompanying drawings relate to preferred embodiments of the present invention. Various changes and modifications may be made without departing from the spirit and scope of the invention. Thus, by way of example and not of limitation, the present invention is applicable to all types of women's body wear, including bathing suits, tights, pantyhose, leotards, and the like. Further, instead of using COOLMAX TM, other hydrophobic fibers having large surface areas could be employed, preferably those with longitudinal channels included in their structure. In addition, instead of using knit panels, other panels formed of this type of fiber and having a relatively open weave may be employed. Accordingly, the present invention is not limited precisely to the materials and structures described in detail hereinabove and shown in the accompanying drawings.

What is claimed is:

1. A breathable body wear garment comprising:

a main body wear garment having a body and a crotch area, and an inside surface and outside surface;

an inner panel in the main body wear garment in the crotch area thereof, said inner panel being formed of an open knit material formed of a high surface area hydrophobic fibers;

said main body wear garment principally formed of a stretchable material said main body wear garment further comprising a knit panel in an area overlying said inner panel, and being of a more porous material than said main body wear garment material.

2. A breathable body wear garment as defined in claim 1 wherein the color of said main body wear garment material and said inserted exterior panel are different from the color of said inner panel.

3. A breathable garment for women comprising:

a main garment having a body area and a crotch area, and an inside surface and outside surface;

an inner panel having an inner and outer surface inserted in the crotch area of said main garment, and located on the inside surface of said main garment, with said inner surface of said inner panel facing, and immediately adjacent to said inside surface of said main garment; said inner panel being formed of an open knit material formed of high surface area hydrophobic fibers;

said inner panel being seamed along all edges thereof to prevent unravelling;

said inner panel being formed of threads made up of bundles of said hydrophobic fibers;

said high surface area hydrophobic fibers of said inner panel having longitudinally extending channels on the outer surface of said inner panel;

said main garment being formed of thin stretchable material, and said inner panel being formed of material which is substantially thicker and substantially more porous than said thin stretchable material;

said main garment principally formed of a stretchable material, and wherein said main body wear garment has, in an area overlying said inner panel, porous material constituting means for permitting significant air circulation through said main body wear garment to promote evaporation of moisture transferred from said inner panel to said main garment.

4. A breathable garment as defined in claim 3 wherein the color of said main garment material and said inserted exterior panel are different from the color of said inner panel.

5. A breathable garment for women as described in claim 3 in which the crotch area of said body wear garment consists solely of said inner panel layer and one thin outer layer of stretchable material.

6. A breathable garment comprising:

a main garment having a body portion and a crotch area, and an inside surface and outside surface;

an inner panel attached to said inside surface of said main garment located in the crotch area thereof, said inner panel being formed of an open knit material formed of high surface area hydrophobic fibers;

said inner panel being seamed along all edges thereof to prevent unraveling;

said inner panel being formed of threads made up of bundles of said hydrophobic fibers;

said main garment being formed of a thin stretchable material, and said inner panel being formed of material which is substantially more porous than said thin stretchable material.

7. A breathable garment as described in claim 6 wherein said inner panel is of the same color as the adjacent areas of the main garment.

8. A breathable garment as described in claim 6 wherein said inner panel is of a different color than the adjacent areas of the main garment.

9. A breathable garment for women comprising:

A main garment having a body portion and a crotch area, and an inside surface and outside surface;

An inner panel attached to said inside surface of said main garment located in said crotch area thereof, said inner panel being formed of an open knit material said open knit material formed of threads made up of bundles of said hydrophobic fibers;

said inner panel seamed along all edges thereof to prevent unravelling of said inner panel;

said main garment having, in an area overlying said inner panel, porous material including means for permitting significant air circulation through said crotch area of said main garment to promote evaporation of moisture transferred from said inner panel to said main garment.

10. A breathable garment for women as described in claim 9 in which said crotch area of said main garment consists solely of said inner panel, and one thin layer of outer material which constitutes the main garment.

11. A breathable garment for women as described in claim 9 in which the crotch area of said garment consists solely of said inner panel layer, and multiple thin layers of outer material which constitute the main garment such that moisture can be effectively transferred from the inner panel to the external surface of the garment where said moisture can evaporate.

12. A breathable garment for women as described in claim 9 in which said main garment is formed of thin material, and said inner panel is formed of material which is substantially thicker and substantially more porous than said thin material.

13. A breathable garment for women as described in claim 9 in which said garment is a women's type panty.

* * * * *